US010840010B2

(12) United States Patent
Fujii et al.

(10) Patent No.: US 10,840,010 B2
(45) Date of Patent: Nov. 17, 2020

(54) COIL COMPONENT

(71) Applicant: TDK CORPORATION, Tokyo (JP)

(72) Inventors: Naoaki Fujii, Tokyo (JP); Tomonaga Nishikawa, Tokyo (JP); Kouji Kawamura, Tokyo (JP); Nobuya Takahashi, Tokyo (JP)

(73) Assignee: TDK CORPORATION, Tokyo (JP)

( * ) Notice: Subject to any disclaimer, the term of this patent is extended or adjusted under 35 U.S.C. 154(b) by 97 days.

(21) Appl. No.: 15/961,101

(22) Filed: Apr. 24, 2018

(65) Prior Publication Data

US 2018/0323003 A1 Nov. 8, 2018

(30) Foreign Application Priority Data

May 3, 2017 (JP) ..... 2017-092017

(51) Int. Cl.

| | |
|---|---|
| ***H01F 5/00*** | (2006.01) |
| ***H01F 27/29*** | (2006.01) |
| ***H01F 27/32*** | (2006.01) |
| ***H01F 27/28*** | (2006.01) |
| ***H01F 17/04*** | (2006.01) |
| ***H01F 17/00*** | (2006.01) |

(52) U.S. Cl.

CPC ..... *H01F 27/292* (2013.01); *H01F 17/0013* (2013.01); *H01F 17/04* (2013.01); *H01F 27/2804* (2013.01); *H01F 27/323* (2013.01); *H01F 2017/0066* (2013.01); *H01F 2027/2809* (2013.01)

(58) Field of Classification Search

USPC ..... 336/200, 223, 232

See application file for complete search history.

(56) References Cited

U.S. PATENT DOCUMENTS

| | | | | |
|---|---|---|---|---|
| 5,515,022 | A * | 5/1996 | Tashiro | H01F 17/0013 174/262 |
| 10,475,570 | B2 * | 11/2019 | Kido | H01F 27/2804 |
| 2001/0029662 | A1 | 10/2001 | Uriu et al. | |
| 2002/0009577 | A1 | 1/2002 | Takaya et al. | |
| 2006/0097835 | A1 | 5/2006 | Tomonari et al. | |
| 2008/0257488 | A1 | 10/2008 | Yamano | |
| 2010/0157565 | A1 | 6/2010 | Yoshida et al. | |
| 2011/0291790 | A1 | 12/2011 | Okumura et al. | |

(Continued)

FOREIGN PATENT DOCUMENTS

| | | |
|---|---|---|
| JP | 07-161529 A | 6/1995 |
| JP | 05-258973 A | 6/2006 |

(Continued)

*Primary Examiner* — Ronald Hinson

(74) *Attorney, Agent, or Firm* — Young Law Firm, P.C.

(57) ABSTRACT

Disclosed herein is a coil component that includes a coil part in which a plurality of conductor layers and a plurality of interlayer insulting layers are alternately laminated, and an external terminal. Each of the conductor layers has a coil conductor pattern and an electrode pattern exposed from the coil part. The electrode patterns are connected to each other through a plurality of via conductors penetrating the interlayer insulating layers. At least one of the interlayer insulating layers is exposed from the coil part positioned between the plurality of electrode patterns. The external terminal is formed on the electrode patterns exposed from the coil part so as to avoid an exposed part of the interlayer insulating layer.

19 Claims, 12 Drawing Sheets

(56) References Cited

U.S. PATENT DOCUMENTS

| | | | | |
|---|---|---|---|---|
| 2012/0112869 | A1 | 5/2012 | Nishikawa et al. | |
| 2012/0227250 | A1 | 9/2012 | Yamano | |
| 2012/0249276 | A1 | 10/2012 | Fontana et al. | |
| 2013/0152379 | A1 | 6/2013 | Lee et al. | |
| 2013/0314189 | A1 | 11/2013 | Okumura et al. | |
| 2014/0139307 | A1 | 5/2014 | Kido et al. | |
| 2014/0224418 | A1 | 8/2014 | Seko | |
| 2014/0285303 | A1 | 9/2014 | Cho et al. | |
| 2014/0285306 | A1 | 9/2014 | Sasaki | |
| 2015/0170834 | A1 | 6/2015 | Yamano | |
| 2016/0247630 | A1 | 8/2016 | Kido et al. | |
| 2018/0122548 | A1* | 5/2018 | Kim | H01F 5/04 |
| 2018/0122556 | A1* | 5/2018 | Kim | H01F 27/323 |

FOREIGN PATENT DOCUMENTS

| | | | |
|---|---|---|---|
| JP | 2006-140229 | A | 6/2006 |
| JP | 2012-015493 | A | 1/2012 |
| JP | 2012-104673 | A | 5/2012 |
| JP | 2014-229739 | A | 12/2014 |
| WO | 2007080680 | | 7/2007 |
| WO | 2013103044 | | 7/2013 |

* cited by examiner

COIL COMPONENT

BACKGROUND OF THE INVENTION

Field of the Invention

The present invention relates to a coil component and, more particularly, to a coil component suitably used for a power supply circuit.

Description of Related Art

A surface-mount type coil component generally has a structure in which a plurality of conductor layers and a plurality of interlayer insulating layers are alternately laminated, and one and the other ends of the coil are connected respectively to external terminals formed on the surface of the coil component. For example, a coil component described in International Publication No. 2013/103044 has a structure in which a plurality of conductor layers and a plurality of interlayer insulating layers are alternately laminated. Further, some conductor layers have not only coil conductor patterns but also electrode patterns, and external terminals are formed on the surface of the coil component so as to be connected to the electrode patterns after lamination.

The coil component described in International Publication No. 2013/103044 is so-called a signal coil component, so that the amount of current flowing in the coil is not so large. On the other hand, a coil component used for a power supply circuit is subjected to a larger current than the signal coil component and thus has a large heat generation during actual use.

When a coil component generates heat, a crack may occur at the joint part of a solder due to a difference in thermal expansion coefficient between an external terminal and the solder. This is a phenomenon caused by a smaller thermal expansion coefficient of the external terminal than that of the solder.

SUMMARY

It is therefore an object of the present invention to provide a coil component in which a crack is unlikely to occur at the solder joint part even when heat generation occurs due to a large current.

A coil component according to the present invention has a coil part in which a plurality of conductor layers and a plurality of interlayer insulting layers are alternately laminated and an external terminal. Each of the plurality of conductor layers has a coil conductor pattern and an electrode pattern exposed from the coil part. The plurality of electrode patterns are connected to each other through a plurality of via conductors penetrating the plurality of interlayer insulating layers. At least one of the interlayer insulating layers is exposed from the coil part at a part thereof positioned between the plurality of electrode patterns. The external terminal is formed on the electrode patterns exposed from the coil part so as to avoid the exposed part of the interlayer insulating layer.

According to the present invention, the interlayer insulating layer positioned between the electrode patterns is exposed, and the external terminal is formed so as to avoid the exposed part, so that the effective thermal expansion coefficient of the external terminal is increased by the thermal expansion coefficient of the exposed interlayer insulating layer. As a result, a difference in thermal expansion coefficient between the external terminal and a solder is reduced, so that even when heat generation occurs due to a large current, a crack hardly occurs at the solder joint part, whereby reliability of the coil component can be enhanced.

In the present invention, the formation positions of the plurality of via conductors as viewed in the lamination direction may be at least partially different from each other. With this configuration, flatness of the electrode pattern in each conductor layer can be improved.

In the present invention, at least one of the plurality of via conductors may be exposed from the coil part, and the external terminal may further be formed on the surface of the via conductor exposed from the coil part. With this configuration, the effective thermal expansion coefficient of the external terminal can be adjusted in accordance with the diameter of the via conductor exposed from the coil part. In particular, when there is a need to further increase the effective thermal expansion coefficient of the external terminal, the via conductor exposed from the coil part may be a conformal via.

In the present invention, the conductor layer may be made of copper (Cu), and the external terminal may be made of a laminated film of nickel (Ni) and tin (Sn). With this configuration, it is possible to ensure high wettability with respect to the solder while reducing DC resistance.

The coil component according to the present invention may further have first and second magnetic layers disposed so as to sandwich the coil part in the lamination direction. With this configuration, higher inductance can be obtained.

In the present invention, the plurality of conductor layers may include a first conductor layer in which one end of a coil composed of a plurality of coil conductor patterns is formed, a second conductor layer in which the other end of the coil is formed, and one or more third conductor layers positioned between the first and second conductor layers. The electrode pattern included in the first conductor layer may include a first electrode pattern constituting one end of the coil, and the electrode pattern included in the second conductor layer includes a second electrode pattern constituting the other end of the coil. The electrode pattern included in the first conductor layer further may include a third electrode pattern overlapping the second electrode pattern in the lamination direction, and the electrode pattern included in the second conductor layer further includes a fourth electrode pattern overlapping the first electrode pattern in the lamination direction. The third conductor layer may include a fifth electrode pattern overlapping the second and third electrode patterns in the lamination direction and a sixth electrode pattern overlapping the first and fourth electrode patterns. The plurality of via conductors may include a first via conductor connecting the first and sixth electrode patterns to each other, a second via conductor connecting the third and fifth electrode patterns to each other, a third via conductor connecting the second and fifth electrode patterns to each other, and a fourth via conductor connecting the fourth and sixth electrode patterns to each other. The external terminal may include a first external terminal covering the surfaces of the respective first, fourth, and sixth electrode patterns and a second external terminal covering the surfaces of the respective second, third, and fifth electrode patterns. With the above configuration, a difference in thermal expansion coefficient between the solder and both the first and second external terminals can be reduced.

In this case, the first external terminal may further cover the surface of the first via conductor, and the second external terminal may further cover the surface of the third via conductor. With this configuration, the DC resistances around the first and second external terminals can be reduced further.

In this case, the first and second via conductors may be disposed symmetrically with respect to the center of the coil part, and the third and fourth via conductors may be disposed symmetrically with respect to the center of the coil part. With this configuration, pattern design of the conductor layers and interlayer insulating layers can be facilitated.

As described above, according to the present invention, a crack is unlikely to occur at the solder joint part even when heat generation occurs due to a large current. Thus, there can be provided a highly reliable coil component for a power supply circuit.

BRIEF DESCRIPTION OF THE DRAWINGS

The above and other objects, features and advantages of this invention will become more apparent by reference to the following detailed description of the invention taken in conjunction with the accompanying drawings, wherein.

DETAILED DESCRIPTION OF THE EMBODIMENTS

Preferred embodiments of the present invention will now be explained in detail with reference to the drawings.

Figure 1:
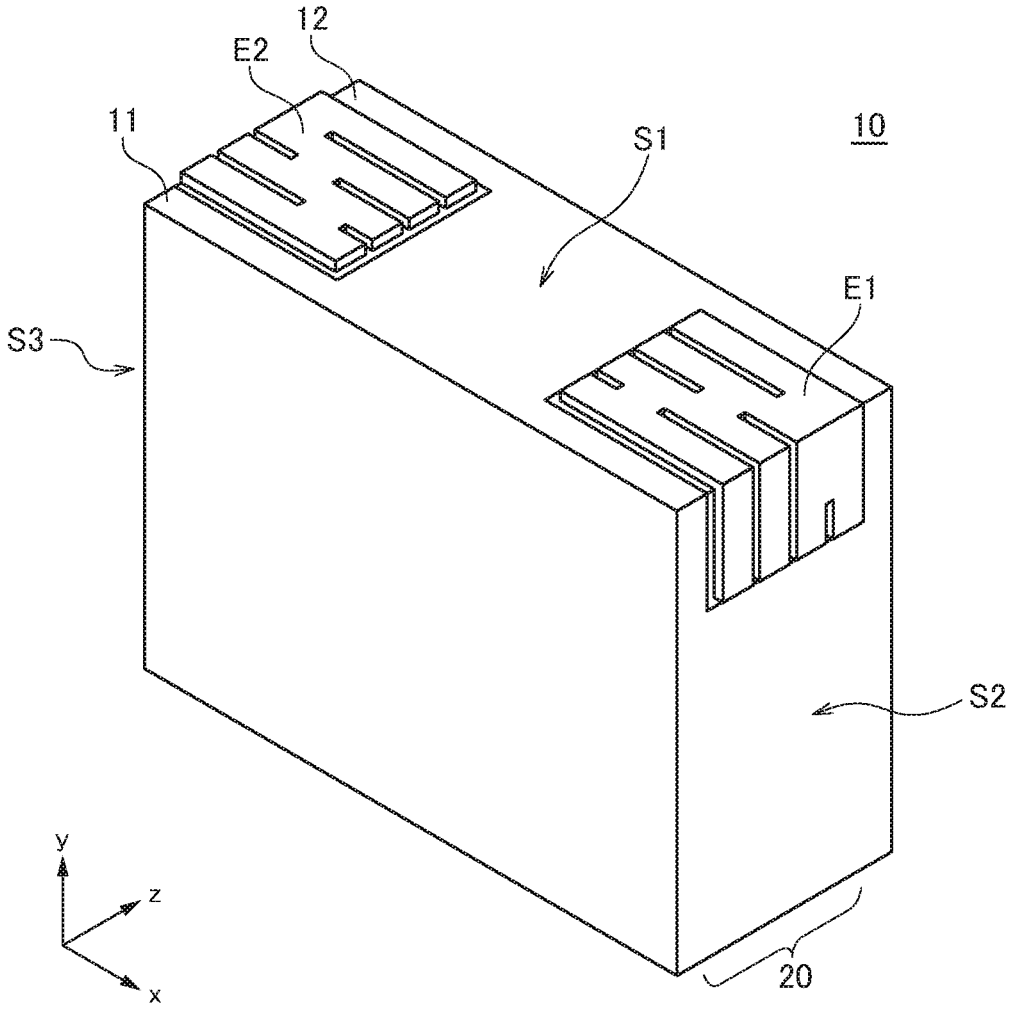
FIG. 1 is a perspective view illustrating the outer appearance of a coil component according to a preferred embodiment of the present invention.

FIG. 1 is a perspective view illustrating the outer appearance of a coil component 10 according to a preferred embodiment of the present invention.

The coil component 10 according to the present embodiment is a surface-mount type chip component suitably used as an inductor for a power supply circuit. As illustrated in FIG. 1, the coil component 10 has first and second magnetic layers 11 and 12 and a coil part 20 sandwiched between the first and second magnetic layers 11 and 12. Although the configuration of the coil part 20 will be described later, in the present embodiment, four conductor layers each having a coil conductor pattern are laminated to form one coil. One end of the coil is connected to a first external terminal E1 and the other end is connected to a second external terminal E2.

Each of the magnetic layers 11 and 12 is a resin composite material containing magnetic powder such as ferrite powder or metal magnetic powder and constitutes a magnetic path of magnetic flux generated by making a current flow in the coil. When the metal magnetic powder is used as the magnetic powder, a permalloy-based material is preferably used. As the resin, liquid or powder epoxy resin is preferably used. However, in the present invention, to constitute the magnetic layers 11 and 12 by the composite material is optional and, for example, a substrate made of a magnetic material such as sintered ferrite may be used as the magnetic layer 11.

Unlike commonly-used laminated coil components, the coil component 10 according to the present embodiment is vertically mounted such that the z-direction which is the lamination direction is parallel to a circuit board. Specifically, a surface S1 constituting the xz plane is used as amounting surface. On the surface S1, the first and second external terminals E1 and E2 are provided. The first external terminal E1 is a terminal connected with one end of a coil formed in the coil part 20, and the second external terminal E2 is a terminal connected with the other end of the coil formed in the coil part 20.

As illustrated in FIG. 1, the first external terminal E1 is continuously formed from the surface S1 to a surface S2 constituting the yz plane, and the second external terminal E2 is continuously formed from the surface S1 to a surface S3 constituting the yz plane. Although details will be described later, each of the external terminals E1 and E2 is made of a laminated film of nickel (Ni) and tin (Sn) formed on the exposed surface of electrode patterns included in the coil part 20. The exposed surface of the electrode patterns does not form a so-called solid pattern, but have a configuration in which interlayer insulating layers are exposed between electrode patterns adjacent in the z-direction. Therefore, the external terminals E1 and E2 are not formed in the exposed part of the interlayer insulating layers are exposed, and the exposed part of the interlayer insulating layers is not basically covered by the external terminals E1 and E2.

Figure 2:
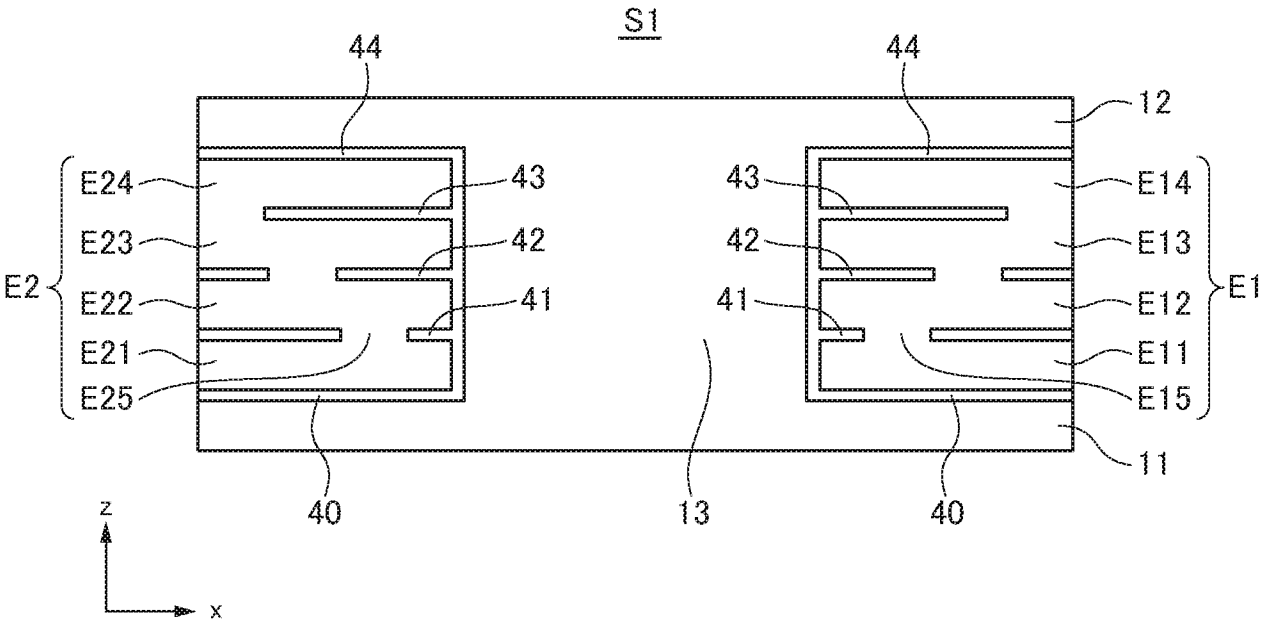
FIGS. 2 to 4 are plan views illustrating the respective surfaces of the coil component shown in FIG. 1.
Figure 3:
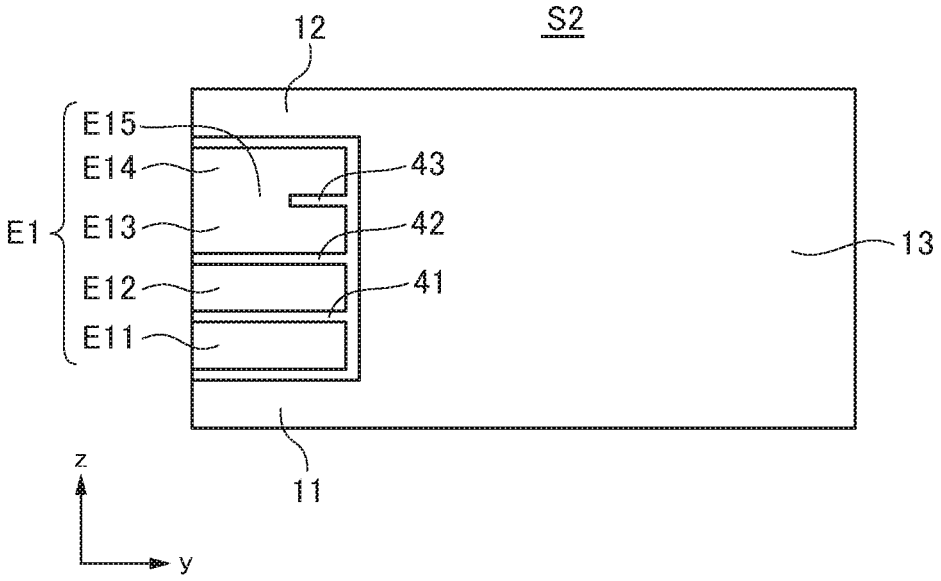
Figure 4:
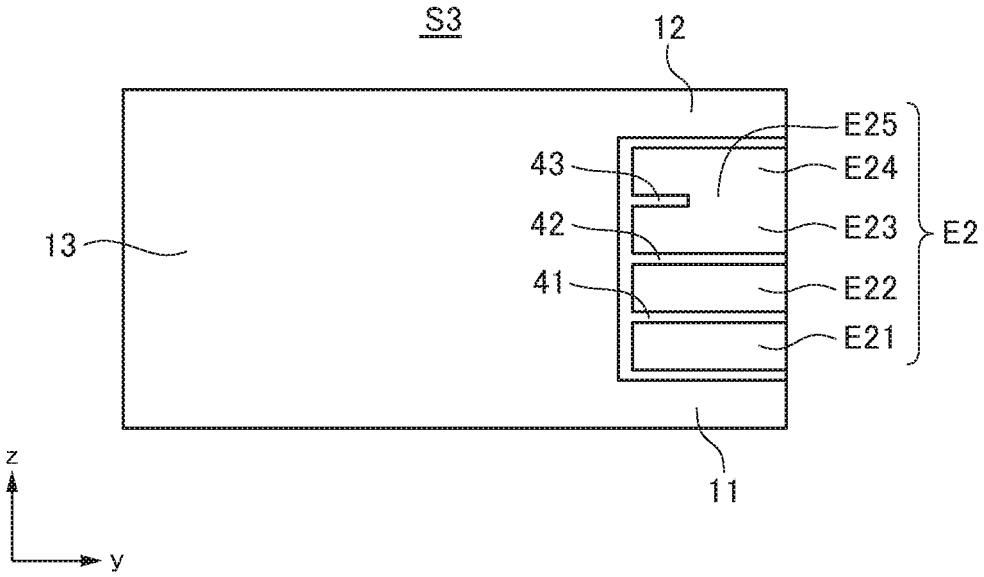

FIGS. 2 to 4 are each a plan view illustrating the structures of the surfaces S1 to S3 of the coil component 10.

As illustrated in FIGS. 2 and 3, the first external terminal E1 is formed on the surfaces S1 and S2 and has first to fourth parts E11 to E14 each extending in the x-direction or y-direction and a fifth part E15 connecting the first to fourth parts E11 to E14. Further, interlayer insulating layers 41 to 43 are exposed in a space between the first to fourth parts E11 to E14 excluding a region where the fifth part E15 exists. Further, as illustrated in FIGS. 2 and 4, the second external terminal E2 is formed on the surfaces S1 and S3 and has first to fourth parts E21 to E24 each extending in the x-direction or y-direction and a fifth part E25 connecting the first to fourth parts E21 to E24. Further, interlayer insulating layers 41 to 43 are exposed in a space between the first to fourth parts E21 to E24 excluding a region where the fifth part E25 exists.

Of the surface of the coil part 20 sandwiched between the magnetic layers 11 and 12, a portion covered by the external terminals E1 and E2 and a portion where the interlayer insulating layers 40 to 44 are not exposed are constituted by a magnetic member 13. The magnetic member 13 plays a role of magnetically connecting the magnetic layers 11 and 12.

Figure 5:
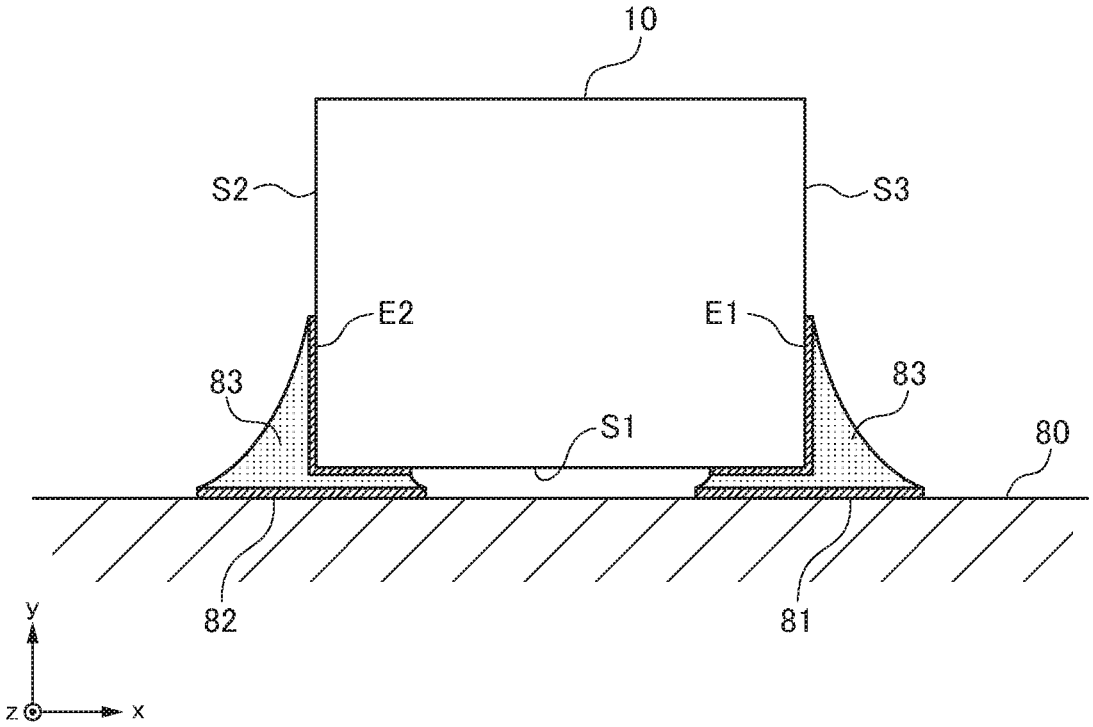
FIG. 5 is a side view illustrating a state where the coil component according to the embodiment of the present invention is mounted on a circuit board as viewed in the lamination direction.

FIG. 5 is a side view illustrating a state where the coil component 10 according to the present embodiment is mounted on a circuit board 80 as viewed in the lamination direction.

As illustrated in FIG. 5, the coil component 10 according to the present embodiment is vertically mounted on the circuit board 80. Specifically, the coil component 10 is mounted such that the surface S1 of the coil part 20 faces the mounting surface of the circuit board 80, that is, the z-direction which is the lamination direction of the coil component 10 is parallel to the mounting surface of the circuit board 80.

Land patterns 81 and 82 are provided on the circuit board 80, and the external terminals E1 and E2 of the coil component 10 are connected respectively to the land pattern 81 and 82. Electrical/mechanical connection between the land patterns 81, 82 and the external terminals E1, E2 is achieved by a solder 83. Fillet of the solder 83 is formed on apart of the external terminal E1 that is formed on the surface S3 of the coil part 20 and a part of the external terminal E2 that is formed on the surface S2 of the coil part 20.

The external terminals E1 and E2 are each made of a laminated film of nickel (Ni) and tin (Sn), and the electrode pattern serving as a base for the external terminals E1 and E2 is made of copper (Cu). Thus, the external terminals E1 and E2 are lower in thermal expansion coefficient than the solder 83. Specifically, the thermal expansion coefficient of copper (Cu) is about 16 ($10^{-6}$/K), and the thermal expansion coefficient of nickel (Ni) is about 13 ($10^{-6}$/K), while the thermal expansion coefficient of the solder is about 25 ($10^{-6}$/K). Thus, when a current is supplied to the coil component 10, a stress occurs at the interface between the solder 83 and external terminals E1 and E2 due to heat generated by the current supply.

On the other hand, in the present embodiment, the external terminals E1 and E2 are divided into the plurality of parts E11 to E14 and the plurality of parts E21 to E24, respectively, and the interlayer insulating layers 41 to 43 are exposed between them, so that the effective thermal expansion coefficient of each of the external terminals E1 and E2 is substantially increased. This is because the thermal expansion coefficient (e.g., about 30 to 60 ($10^{-6}$/K)) of resin which is the material of the interlayer insulating layers 41 to 43 is higher than the thermal expansion coefficient of the solder 83. That is, the thermal expansion coefficient of each of the external terminals E1 and E2 is not changed, but the interlayer insulating layers 41 to 43 each having a high thermal expansion coefficient are partially exposed, whereby the effective thermal expansion coefficient is increased. As a result, a difference from the thermal expansion coefficient of the solder 83 is reduced to thereby significantly reduce the stress caused due to heat generation.

Figure 6:
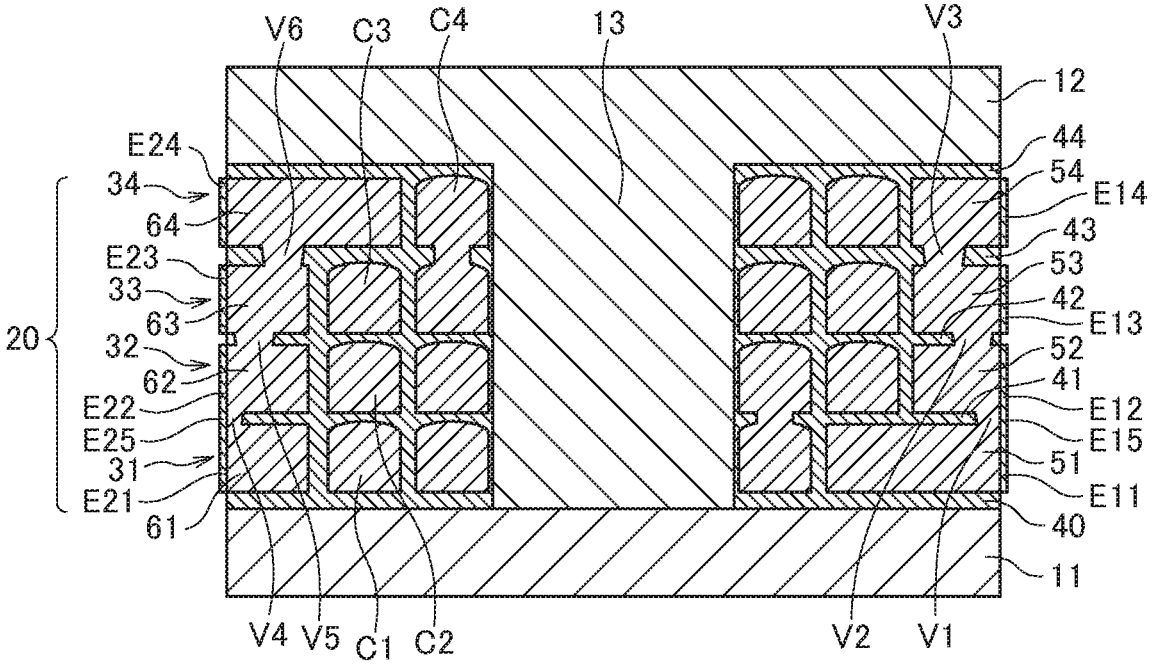
FIG. 6 is a cross-sectional view of the coil component according to the embodiment of the present invention.

FIG. 6 is a cross-sectional view of the coil component 10 according to the present embodiment.

As illustrated in FIG. 6, the coil part 20 included in the coil component 10 is sandwiched between the two magnetic layers 11 and 12 and has a configuration in which the interlayer insulating layers 40 to 44 and the conductor layers 31 to 34 are alternately laminated. The conductor layers 31 to 34 are connected to each other through holes formed respectively in the interlayer insulating layers 41 to 43 to constitute a coil. The magnetic member 13 made of the same material as that of the magnetic layer 12 is embedded in the inner diameter portion of the coil. The interlayer insulating layers 40 to 44 are each made of, e.g., resin, and a non-magnetic material is used at least for the interlayer insulating layers 41 to 43. A magnetic material may be used for the interlayer insulating layers 40 and 44 which are the lowermost and uppermost layers, respectively.

The conductor layer 31 is the first conductor layer formed on the upper surface of the magnetic layer 11 through the interlayer insulating layer 40. The conductor layer 31 includes a coil conductor pattern C1 wound spirally in two turns and two electrode patterns 51 and 61. The electrode pattern 51 is connected to one end of the coil conductor pattern C1, while the electrode pattern 61 is provided independently of the coil conductor pattern C1. The electrode pattern 51 is exposed from the coil part 20, and the first part E11 of the external terminal E1 is formed on the surface thereof. The electrode pattern 61 is exposed from the coil part 20, and the first part E21 of the external terminal E2 is formed on the surface thereof.

The conductor layer 32 is the second conductor layer formed on the upper surface of the conductor layer 31 through the interlayer insulating layer 41. The conductor layer 32 includes a coil conductor pattern C2 wound spirally in two turns and two electrode patterns 52 and 62. The electrode patterns 51 and 52 are provided independently of the coil conductor pattern C2. The electrode pattern 52 is exposed from the coil part 20, and the second part E12 of the external terminal E1 is formed on the surface thereof. The electrode pattern 62 is exposed from the coil part 20, and the second part E22 of the external terminal E2 is formed on the surface thereof.

The conductor layer 33 is the third conductor layer formed on the upper surface of the conductor layer 32 through the interlayer insulating layer 42. The conductor layer 33 includes a coil conductor pattern C3 wound spirally in two turns and two electrode patterns 53 and 63. The electrode patterns 53 and 63 are provided independently of the coil conductor pattern C3. The electrode pattern 53 is exposed from the coil part 20, and the third part E13 of the external terminal E1 is formed on the surface thereof. The electrode pattern 63 is exposed from the coil part 20, and the third part E23 of the external terminal E2 is formed on the surface thereof.

The conductor layer 34 is the fourth conductor layer formed on the upper surface of the conductor layer 33 through the interlayer insulating layer 43. The conductor layer 34 includes a coil conductor pattern C4 wound spirally in two turns and two electrode patterns 54 and 64. The electrode pattern 64 is connected to one end of the coil conductor pattern C4, while the electrode pattern 54 is provided independently of the coil conductor pattern C4. The electrode pattern 54 is exposed from the coil part 20, and the fourth part E14 of the external terminal E1 is formed on the surface thereof. The electrode pattern 64 is exposed from the coil part 20, and the fourth part E24 of the external terminal E2 is formed on the surface thereof.

The coil conductor patterns C1 and C2 are connected to each other through a via conductor penetrating the interlayer insulating layer 41, coil conductor patterns C2 and C3 are connected to each other through a via conductor penetrating the interlayer insulating layer 42, and the coil conductor patterns C3 and C4 are connected to each other through a via conductor penetrating the interlayer insulating layer 43. Thus, an eight-turn coil is obtained by the coil conductor patterns C1 to C4. One end of the obtained eight-turn coil is connected to the first part E11 of the external terminal E1, and the other end thereof is connected to the fourth part E24 of the external terminal E2.

The electrode patterns 51 to 54 are connected to each other through via conductors V1 to V3 penetrating the interlayer insulating layers 41 to 43, respectively. Similarly, the electrode patterns 61 to 64 are connected to each other through via conductors V4 to V6 penetrating the interlayer insulating layers 41 to 43, respectively. When viewed in the lamination direction, the formation positions of the via conductors V1 to V3 differ from one another, and the formation positions of the via conductors V4 to V6 also differ from one another.

In the cross section illustrated in FIG. 6, the via conductor V1 is exposed from the coil part 20 and, thus, the fifth part E15 of the external terminal E1 is formed on the surface of the via conductor V1. On the other hand, the via conductors V2 and V3 are not exposed from the coil part 20 and, thus, a part of the interlayer insulating layer 42 positioned between the electrode patterns 52 and 53 and a part of the interlayer insulating layer 43 positioned between the electrode patterns 53 and 54 are exposed from the coil part 20. Similarly, in the cross section illustrated in FIG. 6, the via conductor V4 is exposed from the coil part 20 and, thus, the fifth part E25 of the external terminal E2 is formed on the surface of the via conductor V4. On the other hand, the via conductors V5 and V6 are not exposed from the coil part 20 and, thus, a part of the interlayer insulating layer 42 positioned between the electrode patterns 62 and 63 and a part of the interlayer insulating layer 43 positioned between the electrode patterns 63 and 64 are exposed from the coil part 20.

As described above, the external terminals E1 and E2 are formed on the surfaces of the electrode patterns 51 to 54, and 61 to 64 exposed from the coil part 20 so as to avoid the exposed parts of the interlayer insulating layers 41 to 43, so that the exposed parts of the interlayer insulating layers 41 to 43 are exposed directly without being covered by the external terminals E1 and E2. As a result, as described above, the effective thermal expansion coefficient of each of the external terminals E1 and E2 is increased, whereby a difference from the thermal expansion coefficient of the solder 83 is reduced.

A recess may be formed at portions on the surfaces of the conductor layers 32 to 34 where the via conductors V1 to V6 are formed. However, in the present embodiment, the formation positions of the via conductors V1 to V3 as viewed in the lamination direction are deviated from one another and, similarly, the formation positions of the via conductors V4 to V6 as viewed in the lamination direction are deviated from one another, so that the recesses formed on the surfaces of the conductor layers 32 to 34 are not accumulated. Thus, high flatness can be ensured.

Further, in the present embodiment, the via conductors V1 and V4 are disposed symmetrically with respect to the center of the coil part 20, the via conductors V2 and V5 are disposed symmetrically with respect to the center of the coil part 20, and the via conductors V3 and V6 are disposed symmetrically with respect to the center of the coil part 20. This facilitates pattern design of the conductor layers 31 to 34 and interlayer insulating layers 41 to 43.

The following describes the manufacturing method for the coil component 10 according to the present embodiment.

FIGS. 7A to 7F and 8A to 8D are process views for explaining the manufacturing processes of the coil component 10 according to the present embodiment. FIGS. 9A to 9H are plan views for explaining pattern shapes in respective processes.

Figure 7A:
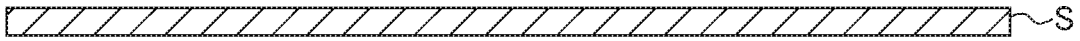
FIGS. 7A to 7F and 8A to 8D are process views for explaining the manufacturing processes of the coil component according to the embodiment of the present invention.
Figure 7B:
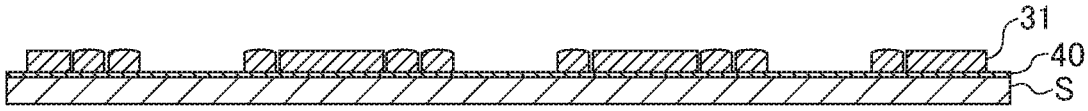

As illustrated in FIG. 7A, a support substrate S having predetermined strength is prepared, and a resin material is applied on the upper surface of the support substrate S by a spin coating method, whereby the interlayer insulating layer 40 is formed. Then, as illustrated in FIG. 7B, the conductor layer 31 is formed on the upper surface of the interlayer insulating layer 40. Preferably, as the formation method for the conductor layer 31, a base metal film is formed using a thin-film formation process such as sputtering, and then the resulting base metal film is grown by plating to a desired film thickness using an electroplating method. The conductor layers 32 to 34 to be formed subsequently are formed in the same manner.

Figures 9E, 9F, 9G, 9H:
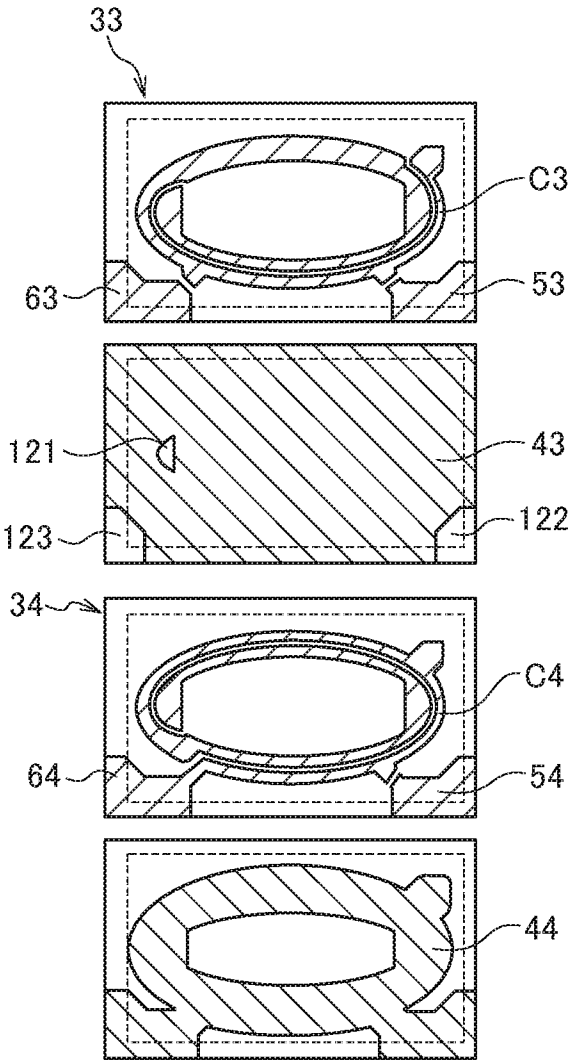
FIGS. 9A to 9H are plan views for explaining pattern shapes in respective processes.
Figures 9A, 9B, 9C, 9D:
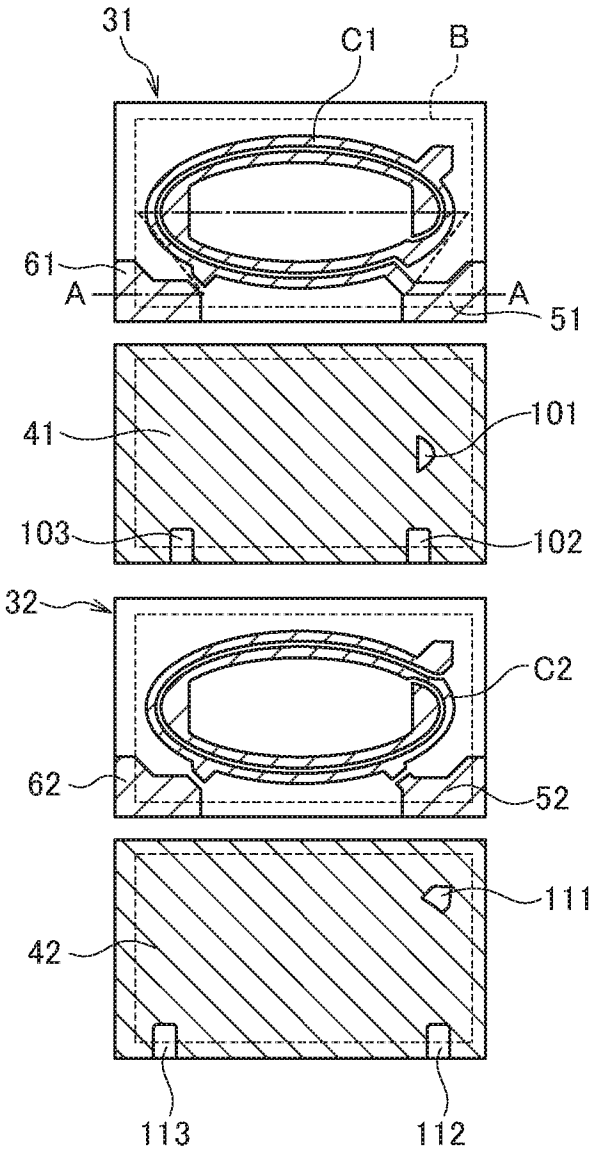

The conductor layer 31 has a planar shape as illustrated in FIG. 9A and includes the coil conductor pattern C1 wound spirally in two turns and two electrode patterns 51 and 61. The line A-A illustrated in FIG. 9A denotes the cross-section position of FIG. 6, and the reference symbol B denotes the final product region of the coil component 10.

Then, as illustrated in FIG. 9B, the interlayer insulating layer 41 that covers the conductor layer 31 is formed. Preferably, the interlayer insulating layer 41 is formed by applying a resin material using a spin coating method, followed by patterning by photolithography method. The interlayer insulating layers 42 to 44 to be formed subsequently are formed in the same manner. The interlayer insulating layer 41 has through holes 101 to 103 through which the conductor layer 31 is exposed. The through hole 101 is formed at a position through which the inner peripheral end of the coil conductor pattern C1 is exposed, the through hole 102 is formed at a position through which the electrode pattern 51 is exposed, and the through hole 103 is formed at a position through which the electrode pattern 61 is exposed.

Figure 7C:
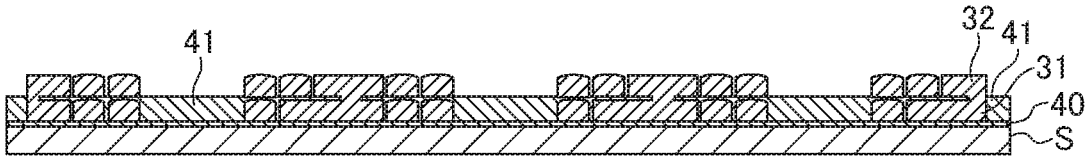

Then, as illustrated in FIG. 7C, the conductor layer 32 is formed on the upper surface of the interlayer insulating layer 41. The conductor layer 32 has a planar shape as illustrated in FIG. 9C and includes the coil conductor pattern C2 wound spirally in two turns and two electrode patterns 52 and 62. As a result, the inner peripheral end of the coil conductor pattern C2 is connected to the inner peripheral end of the coil conductor pattern C1 through the through hole 101. The electrode pattern 52 is connected to the electrode pattern 51 through the through hole 102, and the electrode pattern 62 is connected to the electrode pattern 61 through the through hole 103. A part of the electrode pattern 52 that is embedded in the through hole 102 constitutes the via conductor V1, and a part of the electrode pattern 62 that is embedded in the through hole 103 constitutes the via conductor V4.

Then, as illustrated in FIG. 9D, the interlayer insulating layer 42 that covers the conductor layer 32 is formed. The interlayer insulating layer 42 has through holes 111 to 113 through which the conductor layer 32 is exposed. The through hole 111 is formed at a position through which the outer peripheral end of the coil conductor pattern C2 is exposed, the through hole 112 is formed at a position through which the electrode pattern 52 is exposed, and the through hole 113 is formed at a position through which the electrode pattern 62 is exposed. As is clear from comparison between FIG. 9B and FIG. 9D, the formation position of the through hole 112 is offset from the formation position of the through hole 102, and the formation position of the through hole 113 is offset from the formation position of the through hole 103.

Figure 7D:
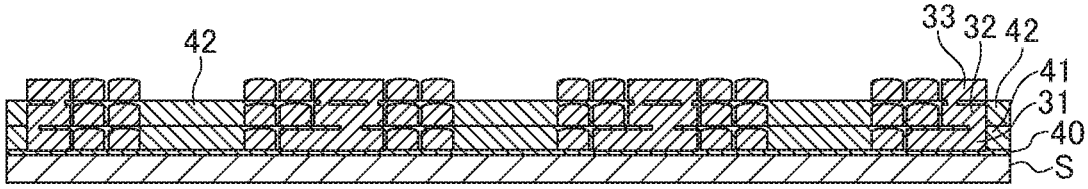

Then, as illustrated in FIG. 7D, the conductor layer 33 is formed on the upper surface of the interlayer insulating layer 42. The conductor layer 33 has a planar shape as illustrated in FIG. 9E and includes the coil conductor pattern C3 wound spirally in two turns and two electrode patterns 53 and 63. As a result, the outer peripheral end of the coil conductor pattern C3 is connected to the outer peripheral end of the coil conductor pattern C2 through the through hole 111. The electrode pattern 53 is connected to the electrode pattern 52 through the through hole 112, and the electrode pattern 63 is connected to the electrode pattern 62 through the through hole 113. Apart of the electrode pattern 53 that is embedded in the through hole 112 constitutes the via conductor V2, and a part of the electrode pattern 63 that is embedded in the through hole 113 constitutes the via conductor V5. The via conductor V2 is formed at a position offset from the via conductor V1, and the via conductor V5 is formed at a position offset from the via conductor V4.

Then, as illustrated in FIG. 9F, the interlayer insulating layer 43 that covers the conductor layer 33 is formed. The interlayer insulating layer 43 has through holes 121 to 123 through which the conductor layer 33 is exposed. The through hole 121 is formed at a position through which the inner peripheral end of the coil conductor pattern C3 is exposed, the through hole 122 is formed at a position through which the electrode pattern 53 is exposed, and the through hole 123 is formed at a position through which the electrode pattern 63 is exposed. As is clear from comparison among FIG. 9B, FIG. 9D, and FIG. 9F, the formation position of the through hole 122 is offset from the formation positions of the through holes 102 and 112, and the formation position of the through hole 123 is offset from the formation positions of the through holes 103 and 113.

Figure 7E:
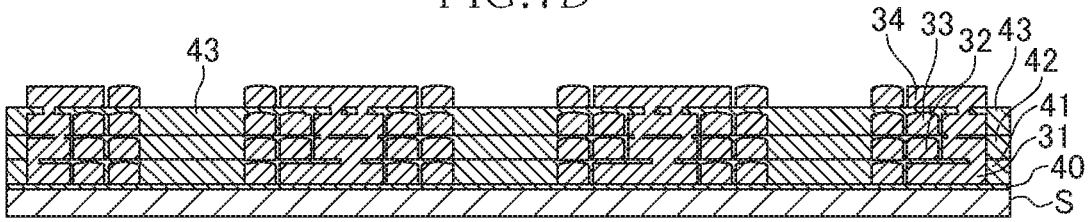

Then, as illustrated in FIG. 7E, the conductor layer 34 is formed on the upper surface of the interlayer insulating layer 43. The conductor layer 34 has a planar shape as illustrated in FIG. 9G and includes the coil conductor pattern C4 wound spirally in two turns and two electrode patterns 54 and 64. As a result, the inner peripheral end of the coil conductor pattern C4 is connected to the inner peripheral end of the coil conductor pattern C3 through the through hole 121. The electrode pattern 54 is connected to the electrode pattern 53 through the through hole 122, and the electrode pattern 64 is connected to the electrode pattern 63 through the through hole 123. Apart of the electrode pattern 54 that is embedded in the through hole 122 constitutes the via conductor V3, and a part of the electrode pattern 64 that is embedded in the through hole 123 constitutes the via conductor V6. The via conductor V3 is formed at a position offset from the via conductors V1 and V2, and the via conductor V6 is formed at a position offset from the via conductors V4 and V5.

Figure 7F:
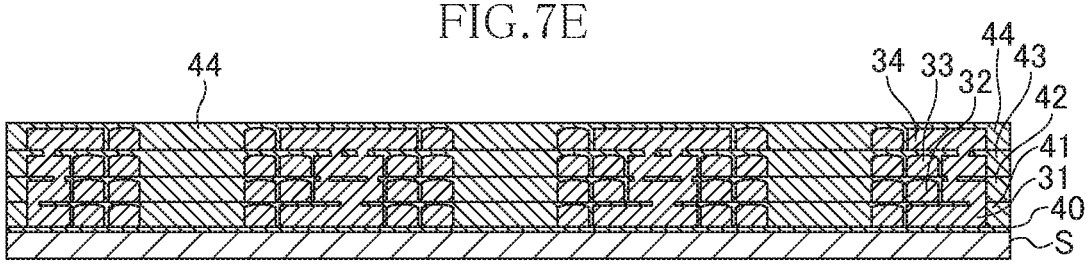

Then, as illustrated in FIG. 7F, the interlayer insulating layer 44 that covers the conductor layer 34 is formed on the entire surface and is then patterned as illustrated in FIG. 9H. As a result, the coil conductor pattern C4 and electrode patterns 54 and 64 are covered by the interlayer insulating layer 44, and the remaining region is exposed.

Figure 8A:
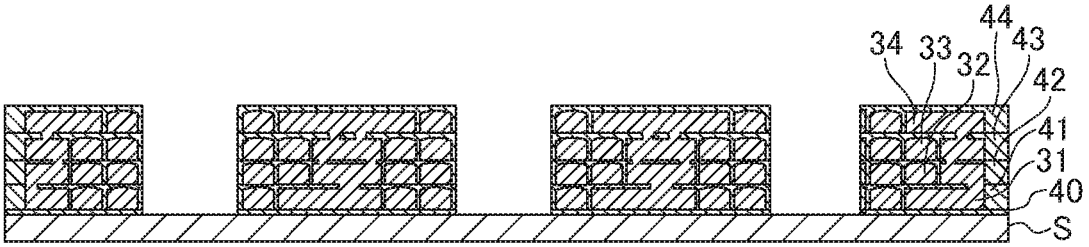

Then, as illustrated in FIG. 8A, dry etching is performed using the patterned interlayer insulating layer 44 as a mask. As a result, apart of each of the interlayer insulating layers 40 to 43 that is not covered by the mask is removed, and a space is formed in the inner diameter region surrounded by the coil conductor patterns C1 to C4 and the coil external region positioned outside the coil conductor patterns C1 to C4.

Figure 8B:
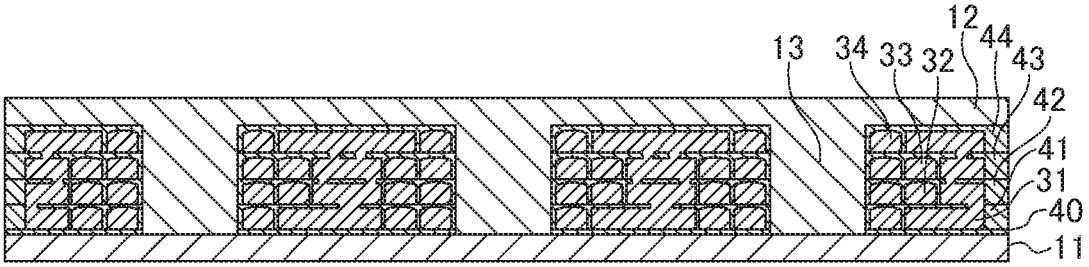

Then, as illustrated in FIG. 8B, a resin composite material containing ferrite powder or metal magnetic powder is embedded in the space formed by the removal of the interlayer insulating layers 40 to 43. As a result, the magnetic layer 12 is formed above the coil conductor patterns C1 to C4, and the magnetic member 13 is formed in the inner diameter region surrounded by the coil conductor patterns C1 to C4 and the coil external region positioned outside the coil conductor patterns C1 to C4. After that, the support substrate S is peeled off, and the composite material is formed on the lower surface side of the coil conductor patterns C1 to C4 to form the magnetic layer 11.

Figure 8C:
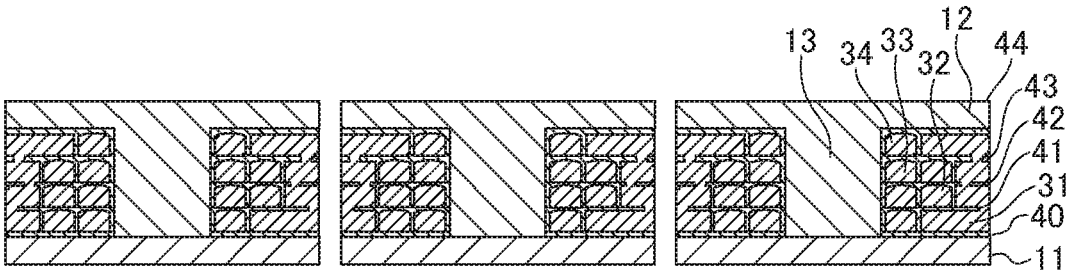
Figure 8D:
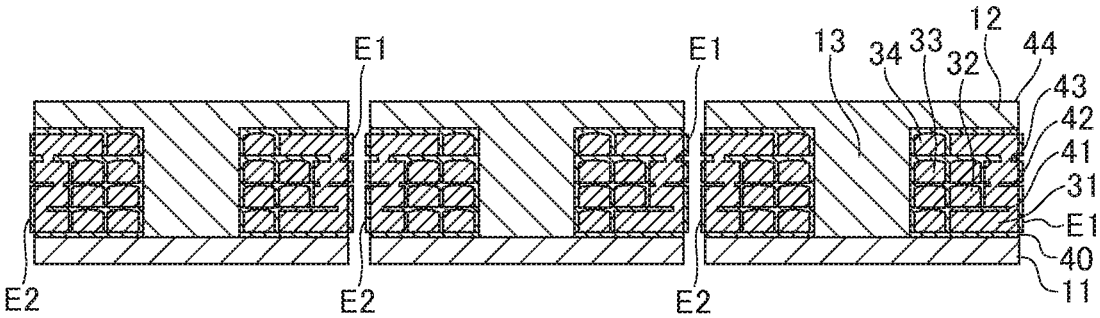

Then, as illustrated in FIG. 8C, dicing is performed for separation into individual semiconductor chips. As a result, the electrode patterns 51 to 54 and 61 to 64 are partially exposed from the dicing surface. Further, the interlayer insulating layers 41 to 43 positioned between the electrode patterns 51 to 54 or electrode patterns 61 to 64 are also partially exposed from the dicing surface. When barrel plating is performed in this state, the external terminals E1 and E2 are formed on the exposed surface of the electrode patterns 51 to 54 and the exposed surface of the electrode patterns 61 to 64, respectively, as illustrated in FIG. 8D. At this time, the external terminals E1 and E2 are formed so as to avoid the exposed parts of the interlayer insulating layers 41 to 43, so that the external terminal E1 is divided into the first to fourth parts E11 to E14, and the external terminal E2 is divided into the first to fourth parts E21 to E24. The first to fourth parts E11 to E14 are connected to each other through the fifth part E15 formed in the exposed parts of the via conductors V1 to V3, and the first to fourth parts E21 to E24 are connected to each other through the fifth part E25 formed in the exposed parts of the via conductors V4 to V6.

Thus, the coil component 10 according to the present embodiment is accomplished.

As described above, in the present embodiment, the planar positions of the through holes 102, 112, and 122 are offset from each other, so that it is possible to reduce overlap between the via conductors V1 to V3. Similarly, the planar positions of the through holes 103, 113, and 123 are offset from each other, so that it is possible to reduce overlap between the via conductors V4 to V6.

FIGS. 10 to 13 are side surface views illustrating variations of the shape of the exposed surface of the electrode patterns 51 to 54.

Figure 10:
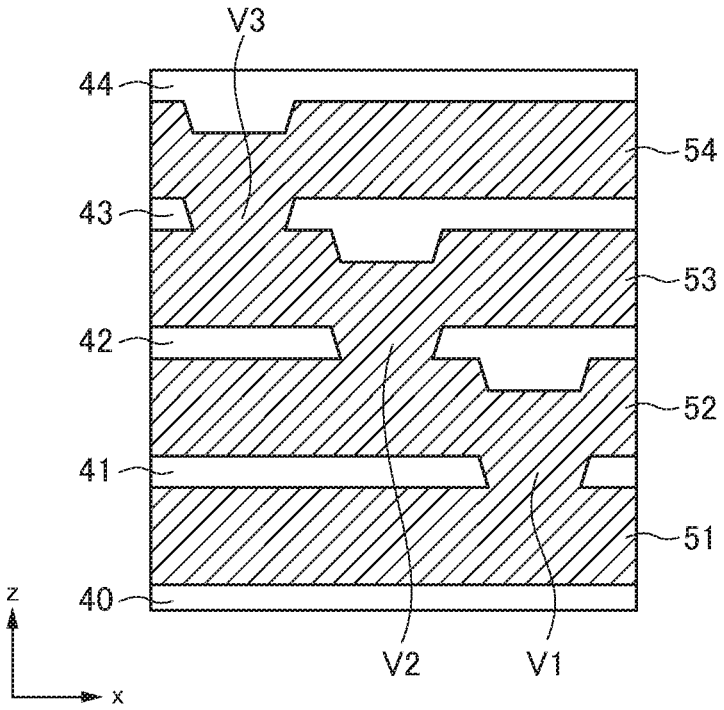
FIGS. 10 to 13 are side surface views illustrating variations of the shape of the exposed surface of the electrode patterns.
Figure 11:
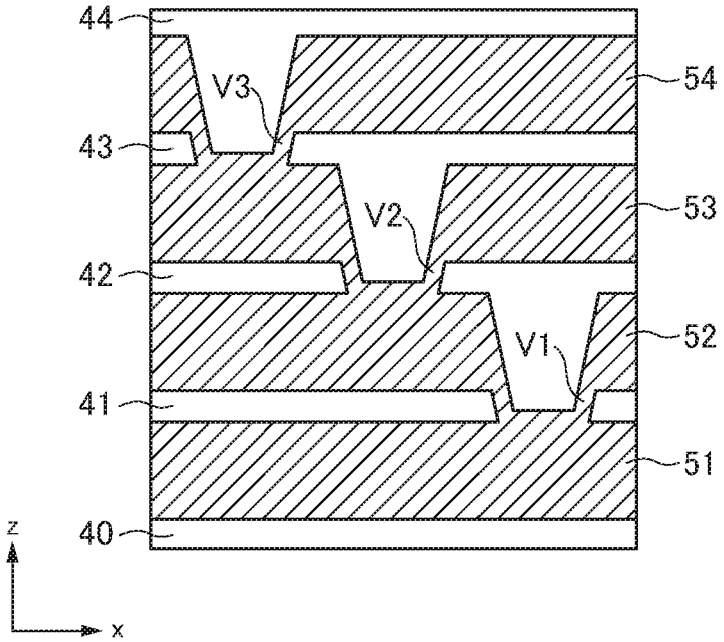
Figure 12:
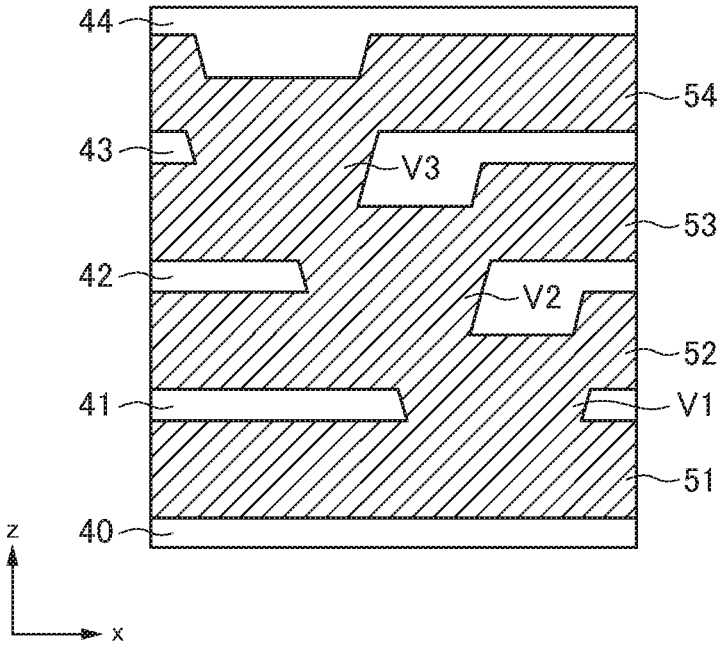
Figure 13:
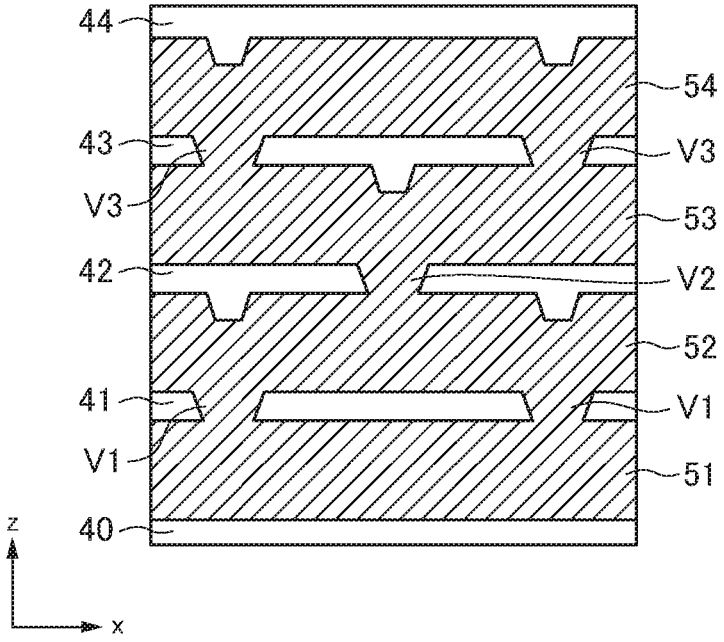

In the example illustrated in FIG. 10, the via conductors V1 to V3 do not overlap each other. Thus, the recesses formed on the surfaces of the electrode patterns 52 to 54 are not accumulated, so that high flatness can be ensured. FIG. 11 illustrates an example in which the via conductors V1 to V3 are each a conformal via. Using the conformal via allows the exposed areas of the respective interlayer insulating layers 41 to 44 in the formation positions of the respective via conductors V1 to V3 to be significantly increased, making it possible to further increase the effective thermal expansion coefficient. FIG. 12 illustrates an example in which the via conductors V1 to V3 partially overlap each other in the lamination direction. Specifically, the via conductors V1 and V2 partially overlap each other in the lamination direction, and the via conductors V2 and V3 partially overlap each other in the lamination direction. However, the via conductors V1 and V3 do not overlap each other in the lamination direction, so that the recesses formed on the surfaces of the conductor layers 32 to 34 are not excessively accumulated. FIG. 13 illustrates an example in which a plurality of via conductors V1, a plurality of via conductors V3, and one via conductor V2 are formed. Thus, in the present invention, the number of the via conductors V1, that of the via conductors V2, and that of the via conductors V3 are not limited to one. Further, in the example illustrated in FIG. 13, while the via conductors V1 and V3 overlap each other in the lamination direction, the via conductor V2 does not exist between the via conductors V1 and V3 when viewed in the lamination direction, so that the recesses formed on the surfaces of the conductor layers 32 to 34 are not accumulated.

Figure 14A:
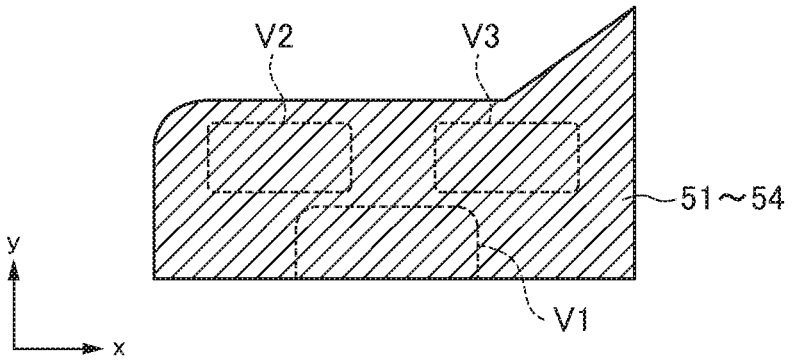
FIGS. 14A and 14B, 15A and 15B, and 16A and 16B are views illustrating variations of the shapes and planar positions of the respective via conductors.
Figure 14B:
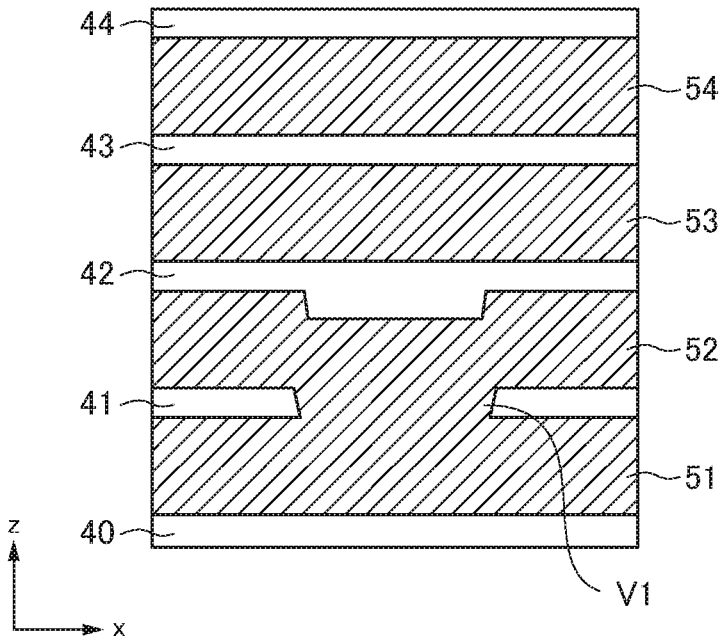
Figure 15A:
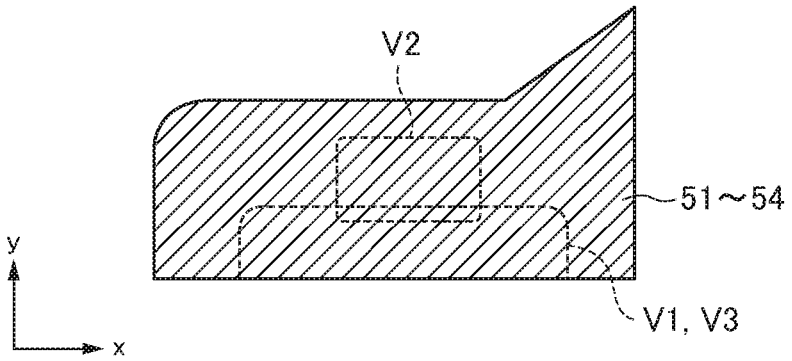
Figure 15B:
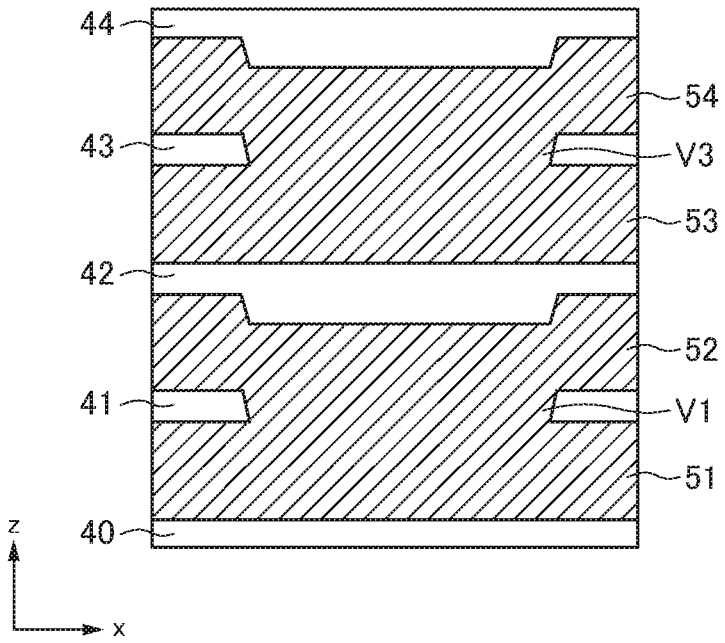
Figure 16A:
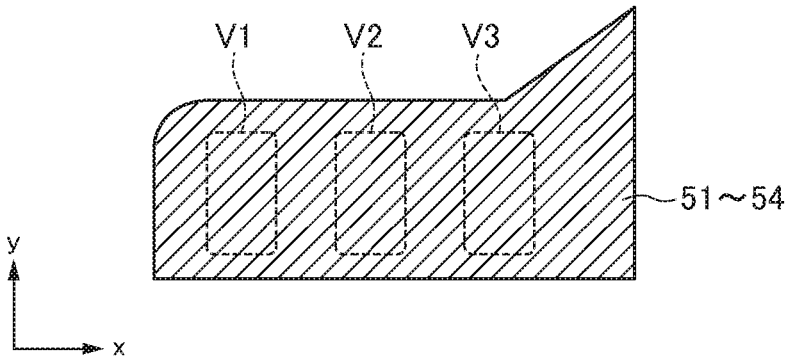
Figure 16B:
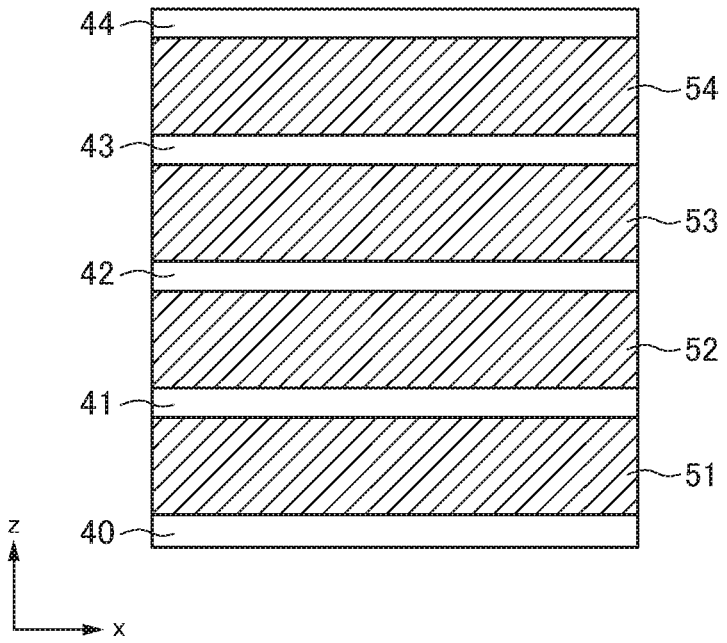

FIGS. 14A and 14B, 15A and 15B, and 16A and 16B are views illustrating variations of the shapes and planar positions of the respective via conductors V1 to V3. FIGS. 14A, 15A, and 16A are plan views, and FIGS. 14B, 15B, and 16B are side surface views.

In the example illustrated in FIGS. 14A and 14B, the via conductors V1 to V3 do not overlap each other in the lamination direction, and only the via conductor V1 is exposed to the side surface. The via conductors V2 and V3 each have no exposed surface. Thus, in the present invention, not all the via conductors V1 to V3 need to be exposed. When there is a need to expose any of the via conductors V1 to V3, the via conductor V1 is preferably exposed as illustrated in FIG. 14B. That is, the electrode pattern 51 constitutes one end of the coil, so that DC resistance can be reduced by sufficiently ensuring the area of the external terminal E1 around the electrode pattern 51. Similarly, when there is a need to expose any of the via conductors V4 to V6, the via conductor V6 is preferably exposed.

In the example illustrated in FIGS. 15A and 15B, the via conductors V1 and V3 are formed at the same position in a plan view, and they partially overlap the via conductor V2. The via conductor V2 has no exposed surface. Thus, a configuration may be adopted, in which one via conductor (V2) is formed inside, and the remaining via conductors (V1, V3) are formed at the same planar positions so as to be exposed. In the example illustrated in FIGS. 16A and 16B, the via conductors V1 to V3 are formed inside and each have no exposed surface. Thus, a configuration may be adopted, in which none of the via conductors V1 to V3 is exposed.

It is apparent that the present invention is not limited to the above embodiments, but may be modified and changed without departing from the scope and spirit of the invention.

For example, in the above embodiment, the coil part 20 includes four conductor layers 31 to 34. However, in the present invention, the number of the conductor layers is not limited to this. Further, the number of turns of the coil conductor pattern formed in each conductor layer is not particularly limited.

What is claimed is:

1. A coil component comprising:
a coil part in which a plurality of conductor layers and a plurality of interlayer insulating layers are alternately laminated; and
an external terminal,
wherein each of the conductor layers has a coil conductor pattern and an electrode pattern exposed from the coil part,
wherein the electrode patterns are connected to each other through a plurality of via conductors penetrating the interlayer insulating layers,
wherein at least one of the interlayer insulating layers is exposed from the coil part positioned between the plurality of electrode patterns, and
wherein the external terminal is formed on the electrode patterns exposed from the coil part so as to avoid an exposed part of the interlayer insulating layer, such that the exposed part of the interlayer insulating layer is exposed from the external terminal without being covered by the external terminal.

2. The coil component as claimed in claim 1, wherein formation positions of the plurality of via conductors as viewed in a lamination direction are at least partially different from each other.

3. The coil component as claimed in claim 1, wherein the conductor layers comprise copper (Cu), and the external terminal comprises a laminated film of nickel (Ni) and tin (Sn).

4. The coil component as claimed in claim 1, further comprising first and second magnetic layers disposed so as to sandwich the coil part in a lamination direction.

5. The coil component as claimed in claim 1,
wherein at least one of the via conductors is exposed from the coil part, and
wherein the external terminal is further formed on a surface of the via conductor exposed from the coil part.

6. The coil component as claimed in claim 5, wherein the via conductor exposed from the coil part is a conformal via.

7. The coil component as claimed in claim 1,
wherein the conductor layers include:
a first conductor layer in which one end of a coil formed by a plurality of the coil conductor patterns is formed;
a second conductor layer in which other end of the coil is formed; and
one or more third conductor layers positioned between the first and second conductor layers,
wherein the electrode pattern included in the first conductor layer includes a first electrode pattern constituting the one end of the coil,
wherein the electrode pattern included in the second conductor layer includes a second electrode pattern constituting the other end of the coil,
wherein the electrode pattern included in the first conductor layer further includes a third electrode pattern overlapping the second electrode pattern in a lamination direction,
wherein the electrode pattern included in the second conductor layer further includes a fourth electrode pattern overlapping the first electrode pattern in the lamination direction,
wherein the third conductor layer includes a fifth electrode pattern overlapping the second and third electrode patterns in the lamination direction and a sixth electrode pattern overlapping the first and fourth electrode patterns,
wherein the via conductors includes:
a first via conductor connecting the first and sixth electrode patterns to each other;
a second via conductor connecting the third and fifth electrode patterns to each other;
a third via conductor connecting the second and fifth electrode patterns to each other; and
a fourth via conductor connecting the fourth and sixth electrode patterns to each other, and
wherein the external terminal includes a first external terminal covering surfaces of the first, fourth, and sixth electrode patterns, and a second external terminal covering surfaces of the second, third, and fifth electrode patterns.

8. The coil component as claimed in claim 7,
wherein the first and second via conductors are disposed symmetrically with respect to a center of the coil part, and
wherein the third and fourth via conductors are disposed symmetrically with respect to the center of the coil part.

9. The coil component as claimed in claim 7,
wherein the coil part has first, second, and third surfaces, each of the first, second, and third surfaces being parallel with the lamination direction, the first surface being perpendicular to the second and third surfaces, the second and third surfaces being parallel with each other,
wherein the first external terminal is formed on the first and second surfaces, and
wherein the second external terminal is formed on the first and third surfaces.

10. The coil component as claimed in claim 9,
wherein the coil part further has fourth and fifth surfaces, each of the fourth and fifth surfaces being perpendicular to the lamination direction, and
wherein the fourth and fifth surfaces are free from the external terminal.

11. The coil component as claimed in claim 7, wherein the first external terminal further covers a surface of the first via conductor, and wherein the second external terminal further covers a surface of the third via conductor.

12. The coil component as claimed in claim 11, wherein the first external terminal further covers a surface of the fourth via conductor, and wherein the second external terminal further covers a surface of the second via conductor.

13. The coil component as claimed in claim 12, wherein the first via conductor is located at different planar position from the fourth via conductor, and wherein the second via conductor is located at different planar position from the third via conductor.

14. The coil component as claimed in claim 13, wherein the plurality of interlayer insulating layers include a first interlayer insulating layer positioned between the first and third conductor layers and a second interlayer insulating layer positioned between the second and third conductor layers, wherein the first interlayer insulating layer has a first side surface parallel with the lamination direction, wherein the second interlayer insulating layer has a second side surface parallel with the lamination direction, wherein the first side surface has a first region located between the surfaces of the first and sixth electrode patterns and exposed from the first external terminal, wherein the second side surface has a second region located between the surfaces of the fourth and sixth electrode patterns and exposed from the first external terminal, and wherein the first region is different in length in a planar direction perpendicular to the lamination direction from the second region.

15. The coil component as claimed in claim 14, wherein the first side surface further has a third region located between the surfaces of the first and sixth electrode patterns and exposed from the first external terminal, and wherein the surface of the first via conductor is located between the first and third regions.

16. The coil component as claimed in claim 15, wherein the first region is different in length in the planar direction from the third region.

17. A coil component comprising:

a first conductor layer having a first coil conductor pattern and a first electrode pattern;

a second conductor layer having a second coil conductor pattern and a second electrode pattern;

an interlayer insulating layer sandwiched between the first and second conductor layer in a lamination direction; and an external terminal, wherein the first and second coil conductor patterns are connected to each other by a first via conductor penetrating the interlayer insulating layer, wherein the first and second electrode patterns are connected to each other by a second via conductor penetrating the interlayer insulating layer, wherein the first electrode pattern has a first exposed surface parallel with the lamination direction, wherein the second electrode pattern has a second exposed surface coplanar with the first exposed surface, wherein the interlayer insulating layer has a third exposed surface coplanar with the first and second exposed surfaces and located between the first and second exposed surfaces in the lamination direction, wherein the second via conductor has a fourth exposed surface coplanar with the first, second, and third exposed surfaces and located between the first and second exposed surfaces in the lamination direction, and wherein the external terminal covers the first, second, and fourth exposed surfaces without covering the third exposed surface such that the third exposed surface is free from the external terminal.

18. The coil component as claimed in claim 17, wherein the interlayer insulating layer further has a fifth exposed surface coplanar with the first, second, third, and fourth exposed surfaces and located between the first and second exposed surfaces in the lamination direction, wherein the fourth exposed surface is located between the third and fifth exposed surfaces in a planar direction perpendicular to the lamination direction, and wherein the fifth exposed surface is free from the external terminal.

19. The coil component as claimed in claim 18, wherein the third exposed surface is different in length in the planar direction from the fifth exposed surface.

* * * * *